US005586595A

United States Patent [19]

Takizawa et al.

[11] Patent Number: 5,586,595

[45] Date of Patent: Dec. 24, 1996

[54] CURTAIN ATTACHMENT CONNECTOR

[75] Inventors: Toshiaki Takizawa; Kazuo Iwai, both of Toyama-ken, Japan

[73] Assignee: YKK Corporation, Tokyo, Japan

[21] Appl. No.: 534,827

[22] Filed: Sep. 27, 1995

[30] Foreign Application Priority Data

Sep. 30, 1994 [JP] Japan ..... 6-236370

[51] Int. Cl.[6] ..... A47H 1/00

[52] U.S. Cl. ..... 160/330; 16/87.2; 24/306; 24/442

[58] Field of Search ..... 24/306, 442, 716, 24/452, 450, 446, 447, 448, 444, 453, 297; 160/330, 345, 368.1; 16/87.2, 87.4 R

[56] References Cited

U.S. PATENT DOCUMENTS 4,653,582 3/1987 Ehrenfried ..... 24/442 X
4,862,563 9/1989 Flynn ..... 24/442
4,984,339 1/1991 Provost et al. ..... 24/442 X
5,012,552 5/1991 Wulf .
5,109,912 5/1992 Gary ..... 160/330

FOREIGN PATENT DOCUMENTS 464754 1/1992 European Pat. Off. .
499461 8/1992 European Pat. Off. .
604869 7/1994 European Pat. Off. ..... 24/442

*Primary Examiner*—Blair Johnson
*Attorney, Agent, or Firm*—Hill, Steadman & Simpson

[57] ABSTRACT

A curtain attachment connector movable along a curtain railing for holding a curtain comprises a fastener member having first and second engaging faces engageable with male or female engaging faces of the curtain, and an attachment extending from one end of the fastener member and adapted to be attached to the curtain railing directly or indirectly. The first and second engaging faces are composed of a multiplicity of hooks rising from front and back sides of the fastener member. The first engaging face has an engaging strength with respect to the engaging faces of the curtain which is stronger than that of the second engaging face.

11 Claims, 10 Drawing Sheets

CURTAIN ATTACHMENT CONNECTOR

BACKGROUND OF THE INVENTION

1. Field of the Invention

This invention relates to a curtain attachment connector that enables various curtains for home and institutional uses, such as theaters and hospitals, to be easily attached to or removed from the suspending materials of curtain railings and curtain holders. More specifically, this invention relates to a curtain attachment connector in which pleats are formed automatically at the top end of the curtain, at the time the curtain is attached to the railings, thereby eliminating the process to provide gatherings to the curtain, and at the same time horizontal opposite ends of the curtain are firmly attached so that the ends are protected even when the curtain is opened or closed by being pulled quickly and strongly.

2. Description of the Related Art

The top end of a curtain to be suspended from the railing normally has gatherings, partly to emphasize the physical beauty of the appearance of the curtain when opened or closed arid partly to prevent the bottom end of the curtain from parting when the curtain is closed. Providing gatherings to the curtain requires complex work of skilled hands and is time-consuming, adversely affecting production costs. By adopting conventional gathering technique, it influences the production cost, so that depending on the uses of the curtain, the gathering process is sometimes omitted for productivity reasons. But curtain without gatherings has lower commercial value and lesser satisfaction to customers.

On the other hand, most of the curtains used at hotels and hospitals are on lease, requiring volume distribution and frequent change and laundering. Therefore, it is desirable to have the curtain structure that is both cost and time efficient at the time of changing and laundering, on the one hand, and that enables automatic pleating at the time of attaching the curtain to the railing and the pleats disappear when curtain is removed from the railing, on the other.

To meet such market needs, U.S. Pat. No. 5,012,552 or of U.S. Pat. No. 5,109,912, for instance, describes a connector in a plate form comprising woven knitted surface fastener adhered to both sides thereof curtain. Those U.S. Patents disclose the ways the surface fastener is pressed onto the corresponding surface fastener adhered to the upper end of the curtain, thus forming pleats and at the same time putting the connector's curtain runners through a curtain railing to attach the curtain. The curtain could be attached to the connector by lightly pressing the surface fastener on the curtain to the corresponding surface fastener on the connector, while the curtain can be removed from the connector by simply separating the two surface fasteners, according to those U.S. Patents.

The curtain connector disclosed in those U.S. Patents, however, does not address the relative strength of engaging of the two surface fasteners. An example described in U.S. Pat. No. 5,012,552, for instance, shows a curtain connector one side of which is a hook surface fastener and the other side is a loop surface fastener, but also indicates that both sides may be of the same engaging structure. As is clear from such description, the attaching of the curtain connector to the curtain is achieved by associating a hook surface fastener to loop surface fastener or vice versa, using the usual woven/knitted surface fasteners, and the engaging strength (tearing strength) on both sides of the curtain connector are equal. Also, the curtain connector described in U.S. Pat. No. 5,109,912 apparently has the surface fasteners with the same engaging strength on both sides thereof as shown in its embodiment.

The curtain connectors as above are generally designed to have the strength to withhold both the weight of the curtain itself and downward pull at the time of opening and closing the curtain. In the case of the curtain connector disclosed in the aforementioned U.S. Patents, the curtain is supported by both sides of the curtain connector. Therefore, the engaging strength in either side of the connector could be set lower than that of a single-face conventional connector. When the total engaging strength is set to correspond to the normal curtain-support strength, however, the engaging strength on either side of the curtain connector is not strong enough to withhold a temporary downward pull at the time of opening and closing of the curtain, and the curtain might come off locally. Conversely, when the engaging strength on both sides of the curtain connector is increased simultaneously, the curtain does not come off the connector easily. However, the impact of the downward pull on the curtain directly works on the curtain connector, thus deforming or damaging the resiliently vulnerable portion of synthetic resin that connects the connector to the curtain railing. The end result is that the curtain comes off, just as in the case of inadequate engaging strength on the connector and that the curtain connector should be replaced before its life expires.

The curtain connector disclosed in the U.S. Patents mentioned above uses regular surface fastener woven or knitted of fabrics as the surface fasteners on both sides, thereby creating no specific manufacturing problems in, for instance, forming hooks in the conventional method. When the surface fasteners are manufactured by integrally molding fastener surfaces and a substrate sheet for higher production efficiency, as disclosed in U.S. Pat. No. 4,984,339 and of European Patent No. 0464753A1, metal mold discs and spacer plates are alternately piled up in a drum shape, then molten thermoplastic resin is extruded onto the surface of the drum while the drum is being rotated, thus pushing resin into the metal mold cavities to mold the hook surface fastener. Then, while molding hooks on the substrate sheet, the hooks in the cavities are pulled off the drum surface together with the substrate sheet in synchronism with the rotation of the drum. In the case of injection molding, the metal mold is opened first, then a molded product is ejected out of the mold by actuating the ejector pin provided inside the metal mold having the hook cavities.

Simultaneous molding of the hooks of the same shape and density onto both sides of the substrate sheet by the rotary drum injection molding as mentioned above, requires the process of pulling out the engaging elements in the cavities, molded on both sides of the substrate sheet off the drum surface in synchronism with the rotation of the drum. Since the engaging elements on both sides of the substrate sheet and the substrate sheet itself are not completely cooled down to be solidified, and since the resistance to the strength to pull the engaging elements out of the cavities is not necessarily the same on each side of the substrate sheet, the engaging elements on either one of the sides may come off first. This tends to cause vibration of the substrate sheet where it is pulled sometime damaging part of the surface fastener and obstructing smooth removal of the engaging elements.

On the other hand, in simultaneous molding of the hooks in the same shape and density onto either side of the substrate sheet by the injection molding, when the injection molding machine is opened to take out the molded product, the areas of both sides of the curtain connector contacting the mold are of the same size. Therefore, it is difficult to predetermine in which metal mold the curtain connector is left, so that it is necessary to provide ejector pins to take the connector out of the mold in both of the molds, thus causing higher production cost.

SUMMARY OF THE INVENTION

With the foregoing problems in view, it is an object of this invention to provide a curtain attachment connector which makes the curtain attachment easier and simpler, enables to make gatherings automatically on the curtain at the time the curtain is attached to the curtain railings, eliminates the need of previous specific processing of the curtain, and absorbs the radical downward, instantaneous impact to avoid damages to the curtain suspending portion, thus improving the production efficiency.

To accomplish the above object, according to this invention, there is provided a curtain attachment connector movable along a guide member, being disposed between the guide member and a curtain and the like having a number of male or female engaging faces at predetermined intervals on and along the upper edge, and having engaging faces which engage with the engaging faces of the curtain. The curtain attachment connector comprises a plate-like fastener member having the engaging faces, and an attachment extending from one end of the fastener member and adapted to be attached to the guide member directly or indirectly. The curtain attachment connector is characterized by that the engaging faces of the fastener member includes first and second engaging faces composed of a multiplicity of hooks rising from front and back sides of the fastener member, and that the first and second engaging faces have different engaging strengths from each other.

Preferably, the fastener member and the attachment are molded integrally. The attachment may have a hook-shape, or alternatively, the attachment has a neck protruding from one end of the surface fastener, and a flange formed on at least a free end of the neck.

Also preferably, the attachment has a hook-shaped member attached to the surface fastener so as to rotate freely about a vertical axis of the attachment.

The hooks of the first and second engaging faces may be integrally molded on the respective front and back sides of the fastener member. The fastener member may have first and second substrate sheets in the form of woven or knitted fabrics, the hooks of the first and second engaging faces being formed by cutting a part of each of loops of monofilament woven or knitted with the first and second substrate sheets, the respective back sides of the first and second substrate sheets being adhered onto the front and back sides of the fastener member. Or the fastener member may be composed of first and second substrate sheets on which the hooks of the first and second engaging faces are respectively molded, the first and second substrate sheets being adhered onto each other's back side.

Preferably, the first and second engaging faces may be different in hook density from each other. Or the hooks of the first and second engaging faces may be made of materials different in rigidity from each other. Alternatively, each of the hooks of one of the first and second engaging faces has a curving portion shorter than that of each of the hooks of the other engaging face.

To provide gatherings to the curtain with the curtain attachment connector of this invention, the fastener member is disposed into a gap between a pair of female surface fasteners that are inset along the upper edge of the curtain so as to be sandwiched by the surface fasteners. And by pressing the pair of female surface fasteners to the first and second engaging faces of the fastener member of the connector respectively, the female surface fasteners engage with those engaging faces. Thus, the curtain attachment connector of this invention enables, at the time of attaching the curtain to the railings, the gatherings to be formed at regular intervals, without prior gathering processes that can be laborious and time-consuming.

Since the engaging strength is different on either side of the fastener member, when the first engaging face of each connector is attached to the curtain in such a way to face in a common direction, then the curtain is pulled forcibly from the second engaging face side that has weaker engaging strength, facing in opposite directions, each connector rotates horizontally to cause the second engaging face to be detached one by one from the female surface fasteners of the curtain so that the curtain loses its gatherings.

When a pair of female surface fasteners is attached to a transverse end corner of the curtain, the connector of this invention can be affixed to the upper corner of the curtain, with end of the curtain folded horizontally, thereby hiding the connector by the upper end of the curtain, and at the same time flares appear at the bottom end of the curtain, eliminating the gap at the transverse end of the curtain.

With difference in the engaging strengths of the first and second engaging faces, which is a characteristic feature of this invention, the following additional advantages are also made possible. Because of the different engaging strength on either side of the connector, a temporary downward impact at the time of opening and closing the curtain can be buffered as the weaker engaging strength of the second engaging face lets go the adherence first, keeping the first engaging face intact. It also protects the synthetic resin attachment of the connector from the shock, thus eliminating the deformation or damage to the connector and frequent replacement of the connector.

When the curtain attachment connector of this invention is molded integrally, different engaging strength on different sides of the engaging face works in favor of smooth pulling and stable molding, because, due to different density of hooks on different faces, resistance to the pulling strength, in the process of extrusion molding with the rotary drum as hooks inside the cavities are pulled out of the drum in synchronism with the rotation of the drum, varies from one side of the fastener member to the other, thereby letting, for instance, the second engaging face pulled out first, then the first engaging face in orderly way.

When a fastener member with different density of hooks on each side is molded by injection molding, the molded piece can be taken out of the metal molds of the injection molding machine easily, because the first and second engaging-faces of the front and back sides of the curtain attachment connector have different size areas contacting the corresponding molds each other, invariably leaving the first engaging face side to the metal mold. Therefore, the ejector pin is needed only on the metal mold of the first engaging face side, thus simplifying the mechanical structure of the injection molding machine and therefore keeping the production cost at a reasonable level.

DETAILED DESCRIPTION OF PREFERRED EMBODIMENTS

Preferred embodiments of this invention will be described below in detail with reference to the accompanying drawings.

Figure 1:
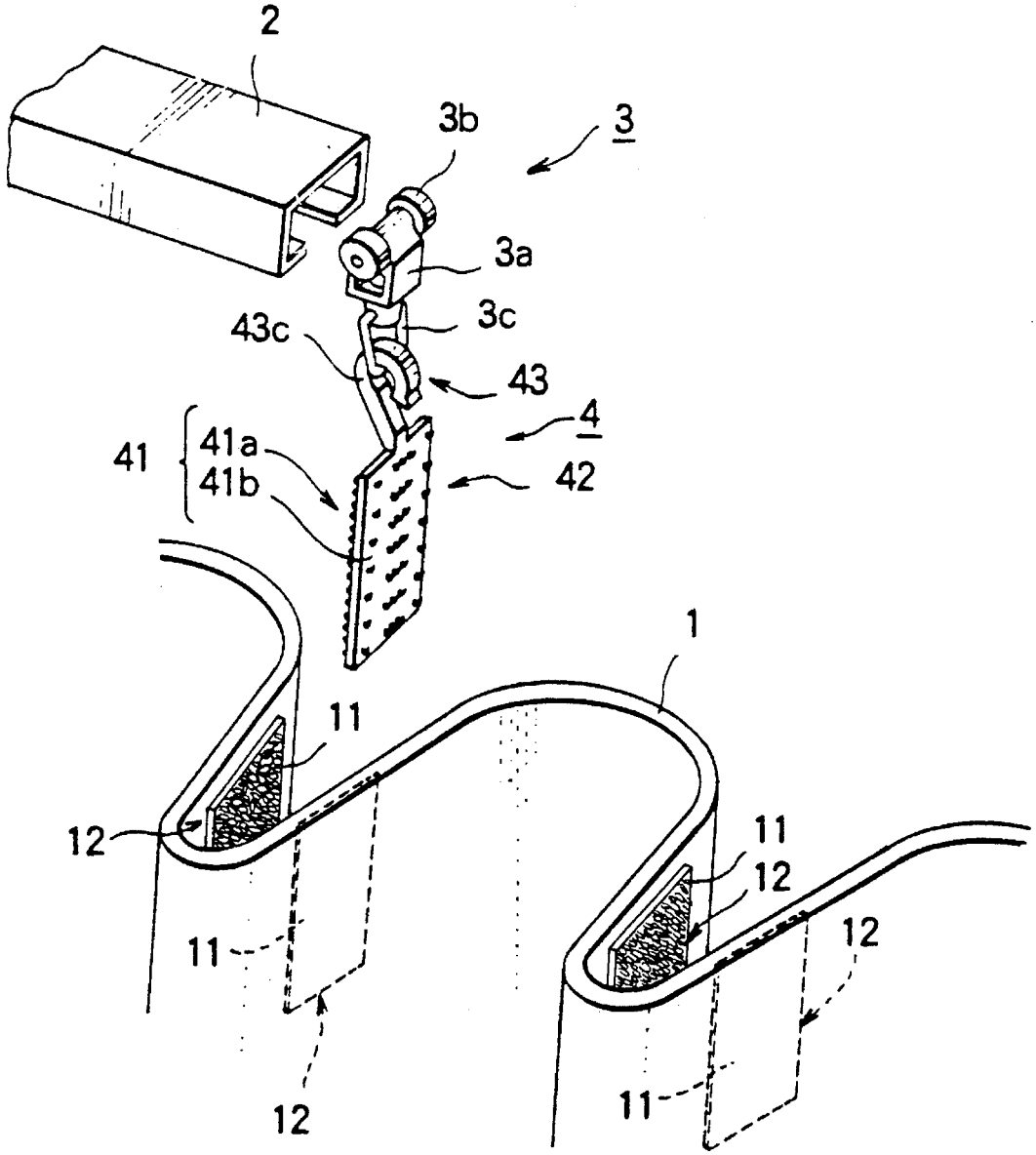
FIG. 1 is a fragmentary, exploded perspective view showing the manner in which a curtain is attached to a curtain attachment connector of this invention.
Figure 2:
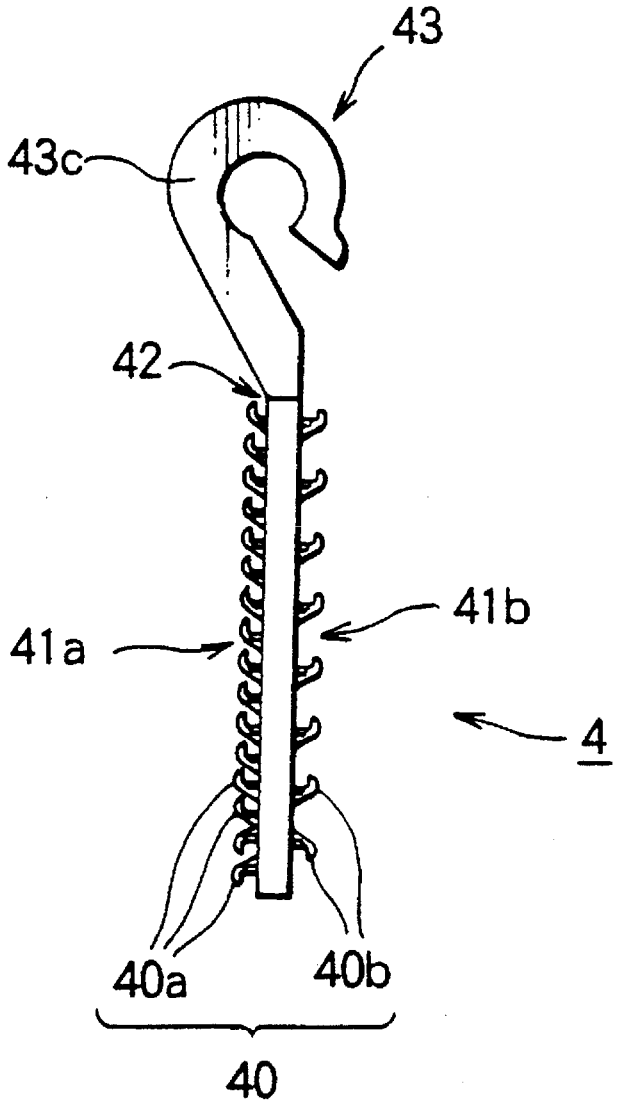
FIG. 2 is a side view of a curtain attachment connector according to a typical embodiment of the invention.

FIG. 1 is a perspective view showing the curtain attachment portion using a curtain attachment connector 4 (hereinafter simply referred to as "connector") according to a first embodiment of the invention. FIG. 2 is a side view of the connector of FIG. 1.

In this embodiment, a pair, of female surface fasteners 12 each having a female engaging face 11 is arranged facing each other at a gap suitable for forming gatherings along an upper edge of a curtain 1. Successive pairs of female surface fasteners 12 are attached to the upper edge of the curtain 1 at a predetermined pitch.

Disposed above the curtail 1 is a curtain railing 2 having a generally C-shaped cross section and a slit-like opening in the bottom, along which a number of curtain runners 3 rolls freely. Specifically, as shown in FIG. 1, each curtain runner 3 has a pair of rollers 3*b* provided at the top of each runner body 3*a* and roll freely, and a downwardly extending ring-shaped support 3*c* at the bottom of the runner body 3*a*. As long as the support 3*c* is at the bottom of the runner body 3*a*, the structure is not necessarily limited to the illustrated example.

A curtain attachment connector 4 of this invention comprises a plate-shaped fastener member 42 that has a multiplicity of hooks 40 on both sides, and a hook-shaped attachment 43 extending from an end of the fastener member 42 to be hung either directly on the curtain railing 2 or via the runner 3. The fastener member 42 includes first and second engaging faces 41*a*, 41*b* having different engaging strength with the same female surface fastener 12.

In the embodiment of FIGS. 1 and 2, the fastener member 42 and hooks 40 on both sides of the fastener member 42 are made of synthetic resin, both molded by injection molding. The engaging faces 41*a*, 41*b* on the front and back sides of the fastener member 42 have different density of hooks 40, with higher density on the engaging face 41*a* than on the engaging face 41*b*, thus making the engaging strength of the latter weaker than the former. In the embodiment of FIGS. 1, the hook-shaped attachment 43 extending integrally from the upper end of the fastener member 42 is threaded through the ring-shaped support 3*c* in a direction perpendicular to the fastener member 42.

Figure 3:
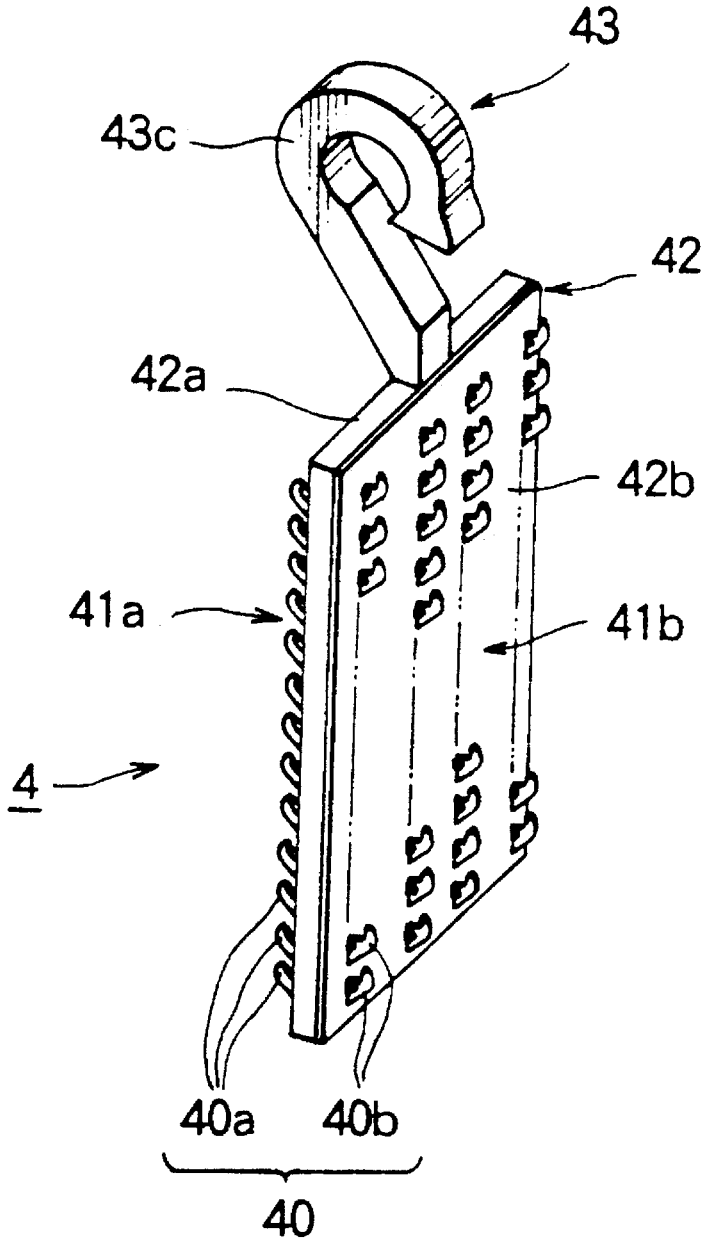
FIG. 3 is a perspective view showing a first modification of the curtain attachment connector.

FIG. 3 shows a first modification of the connector 4. In this modification, the fastener member 42 comprises plate-like first and second substrate sheets 42*a*, 42*b*, both of which are of synthetic resin. A multiplicity of hooks 40 are molded on the surface of each substrate sheet 42*a*, 42*b*. In this modification, more hooks are molded on the first substrate sheet 42*a* than on the second substrate sheet 42*b*. The substrate sheets 42*a*, 42*b* are adhered on their back sides using an adhesive and the like. In the illustrated example, the attachment 43 having a shape same as the above-mentioned hook member extends integrally from the center of the upper end of the first substrate sheet 42*a*.

Figure 4:
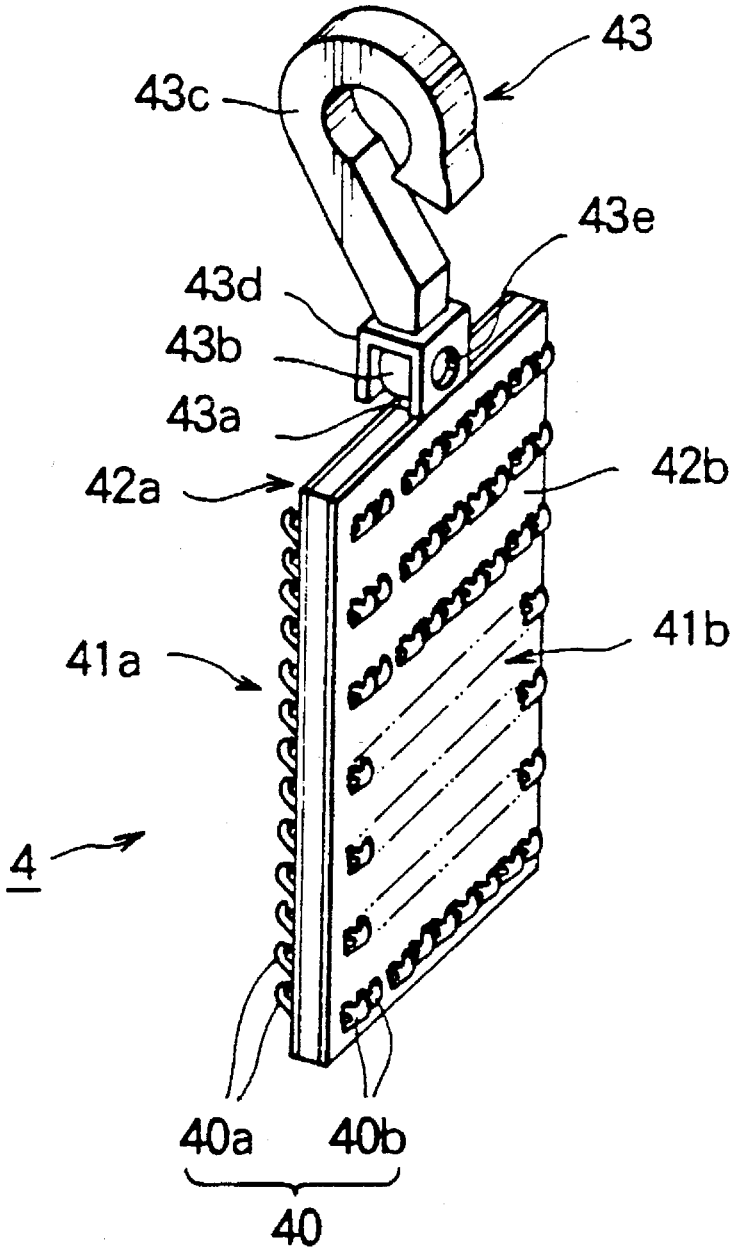
FIG. 4 is a perspective view showing a second modification of the curtain attachment connector.

FIG. 4 shows a second modification of the connector 4. On both sides of the fastener member 42 of the connector 4, the first and second substrate sheets 42*a*, 42*b* are adhered integrally. The hooks 40 are integrally molded on the outer face of the substrate sheet 42*a*, 42*b*. In this modification as well, more hooks are molded on the first substrate sheet 42*a* than on the second substrate sheet 42*b*. Further in this modification, the hook-shaped attachment 43 and the fastener member 42 are separate and are joined together in such a manner that the attachment 43 can rotate about its vertical axis. As shown in FIG. 4, a sphere 43*b* is attached centrally to the upper end of the surface fastener 42 via a neck 43*a*, encircled by a U-shaped connecting piece 43*d* that is attached to the bottom end of a hook member 43*c*. On the opposed vertical walls of the connecting piece 43*d*, holes 43*e* are provided to fit the sphere 43*b*. The hook member 43*c* and the connecting piece 43*d* can be molded separately from the neck 43*a* and the sphere 43*b* before the assembling. It is also possible, however, to simultaneously mold these parts by using an insertion metal mold.

Figure 5:
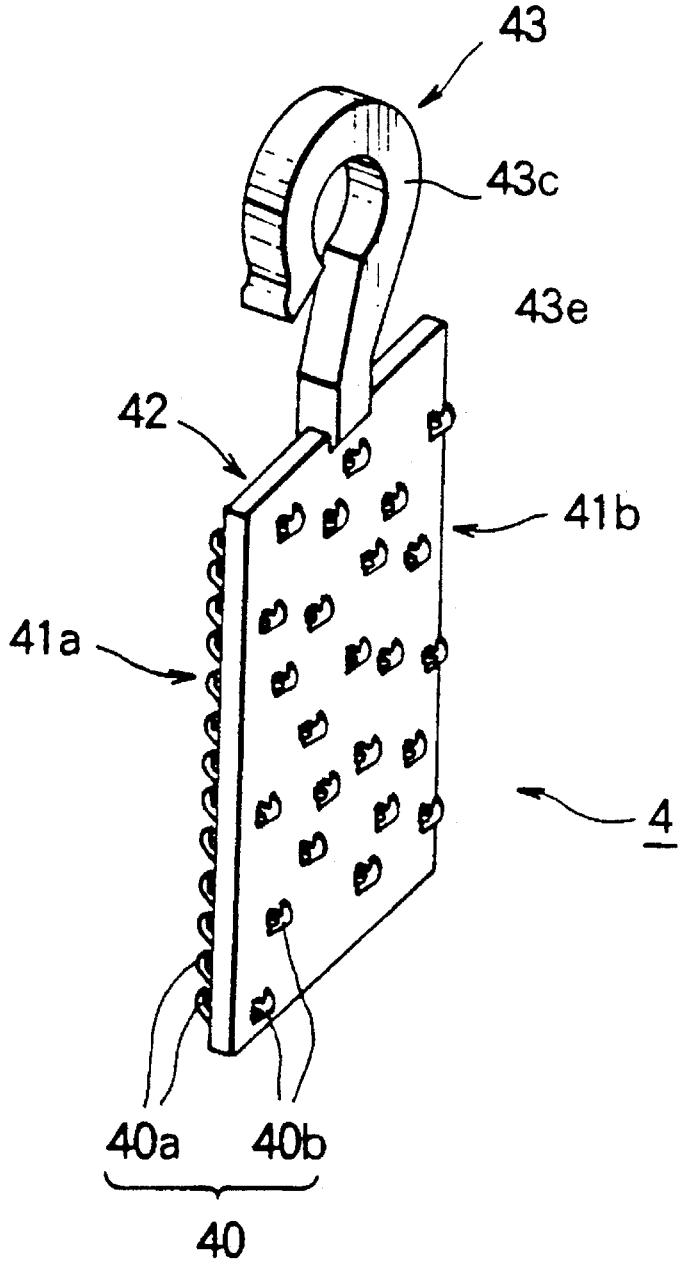
FIG. 5 is a perspective view showing a third modification of the curtain attachment connector.

FIG. 5 shows a third modification of the connector 4. This modification is different from the foregoing modifications in arrangement of the hooks 40 on the fastener member 42. In the examples of FIGS. 1 through 4, the hooks 40 on the first and second engaging surfaces 41*a*, 41*b* are lined either horizontally or vertically in multiple lines. Whereas in the modification of FIG. 5, the hooks are randomly arranged on the second engaging face 41*b*, while those on the first engaging face 41*a* are arranged in an orderly way.

Figure 6:
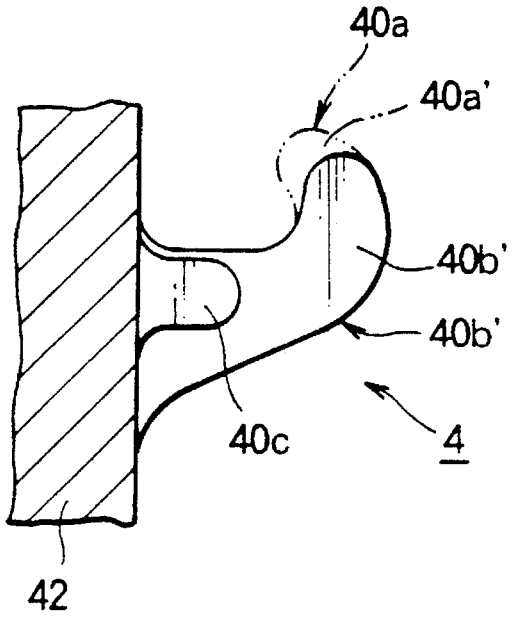
FIG. 6 is a fragmentary enlarged side view, partly in cross section, of the curtain attachment connector, showing an example of shape of a hook formed on a second engaging face.

In the examples of FIGS. 1 through 5, the fastener member 42 is designed to give a different engaging strength to each engaging face 41*a*, 41*b* by varying the hook density. Alternatively, different engaging strengths of the engaging faces 41*a*, 41*b* may be realized by changing the shape of hooks on the first and second engaging faces 41*a*, 41*b*, like a fourth modification shown in FIG. 6. In the fourth modification, by shortening the length of a curving portion 40*a*' on the second engaging face 41*b* than that of a curving portion 40*a*' of the hook 40*a*, which is shown by a dash-and-dot line in FIG. 6, the engaging strength of the female surface fastener 11 to the hooks 40*b* of the second engaging face 41*b* becomes weaker, so that the loop comes off more easily.

In the modifications of FIGS. 3 through 5, the material of the hooks 40*a* on the first engaging face 41*a* is different from that of the hooks 40*b* on the second engaging face 41*b*. For instance, by using polyester resin for the first substrate sheet 42*a* and the hooks 40*a* and polyamide resin for the second substrate sheet 42*b* and the hooks 40*b*, the engaging strength of the second engaging face 41*b* is made weaker than that of the first engaging face 41*a*. It is, of course, also possible to change the rigidity of the hooks 40*a*, 40*b* on the engaging faces 41*a*, 41*b* by using the same family of synthetic resin materials. If the hook rigidity is changed, the hook density may not have to be different between the first and second engaging faces 41*a*, 41*b*.

FIGS. 4 and 5 also show variations in the structure of the hook-shaped attachment 43 of the connector 4 of this invention. The ring-shaped support 3*c* of the curtain runner 3 of the connector 4 of FIG. 1 rotates about its vertical axis, but even in the case that the ring-shaped support 3*c* is not designed to rotate, in the example of FIG. 4, the fastener member 42 can rotate horizontally about the vertical axis with respect to the hook member 43*c* by adopting the above-described structure. On the other hand, in the example of FIG. 5, the hook member 43*c* is attached to the fastener member 42 in parallel to the general plane of the fastener member 42, not perpendicularly to it. With this modified structure, a desired direction is given to the gatherings of the curtain 1, even if the C-shaped support 3*c* does not rotate, bringing the better appearance.

Figure 7:
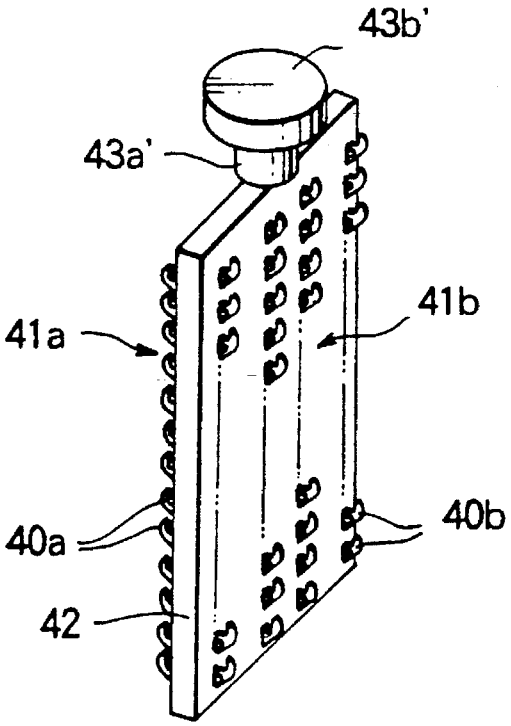
FIG. 7 is a perspective view showing a curtain attachment connector according to another embodiment of the invention.

FIG. 7 shows a second embodiment in which the attachment 43 of the connector 4 is shaped so as to be directly loaded on the railing 2. At the center of the upper end of the fastener member 42 that has the same structure as the structure shown in FIG. 1, the neck 43*a*', to which a flange 43*b*' is attached, protrudes according to the example of FIG. 7. The neck 43*a*' is inserted to the slit opening at the bottom of the railing 2, and at the same time the flange 43*b*' is placed inside the railing 2. The connector 4, thus inserted into the railing 2, moves freely along the curtain railing 2. Horizontal rotation is also possible about the neck 43*a*. Reference numeral 40*c* in FIG. 6 designates a reinforcing rib protruding on the side of the respective hook 40*a*, 40*b*. The same reinforcing ribs 40*c* are formed on all sides of the hooks 40*a*, 40*b* in the examples of FIGS. 1 through 7.

Figure 8:
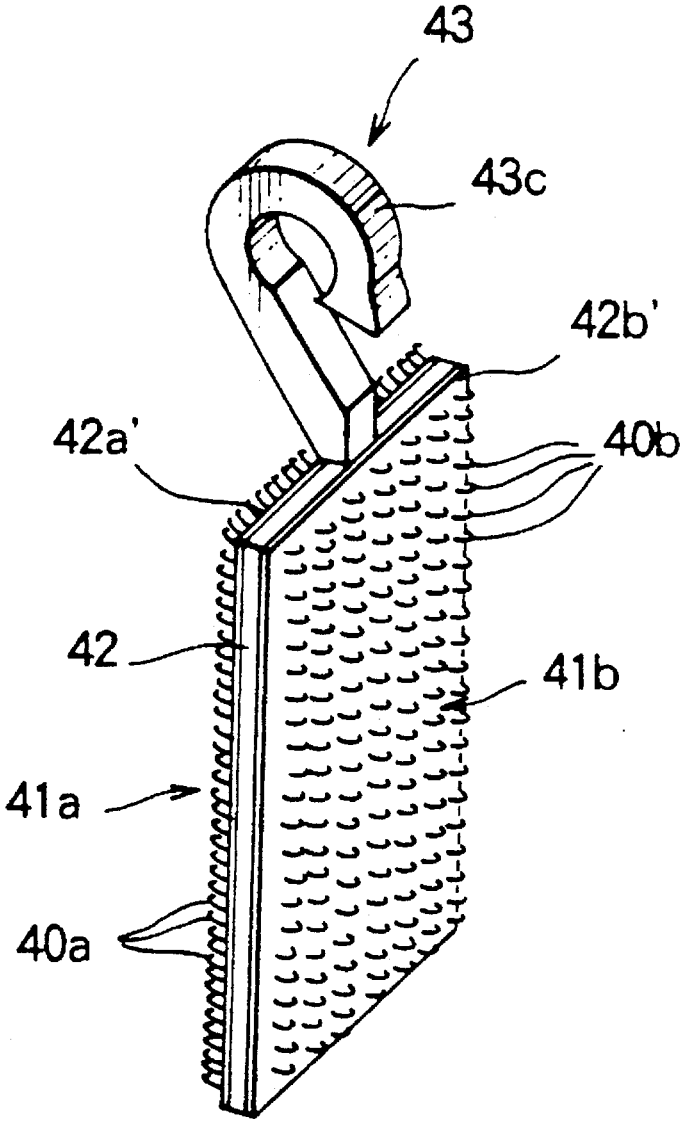
FIG. 8 is a perspective view showing a curtain attachment connector according to still another embodiment of the invention.

In the examples described above, the hooks 40*a*, 40*b* on the first and second engaging faces 41*a*, 41*b* attached to both sides of every fastener member 42 are integrally molded of synthetic resin with the substrate sheet. FIG. 8 shows a third embodiment in which the hooks 40 composing the first and second engaging faces 41*a*, 41*b* are formed by cutting a part of each of monofilament loops standing on the first and second substrate sheets 42*a*', 42*b*' woven or knitted of fabrics including monofilament. In such a case, the back of each of the first and second substrate sheets 42*a*', 42*b*' are adhered onto both sides of the fastener member 42. The hooks 40*a*, 40*b* composing the first and second engaging faces 41*a*, 41*b* have different density or made of materials having different rigidity on each side of the fastener member, likewise in the foregoing examples.

Figure 9:
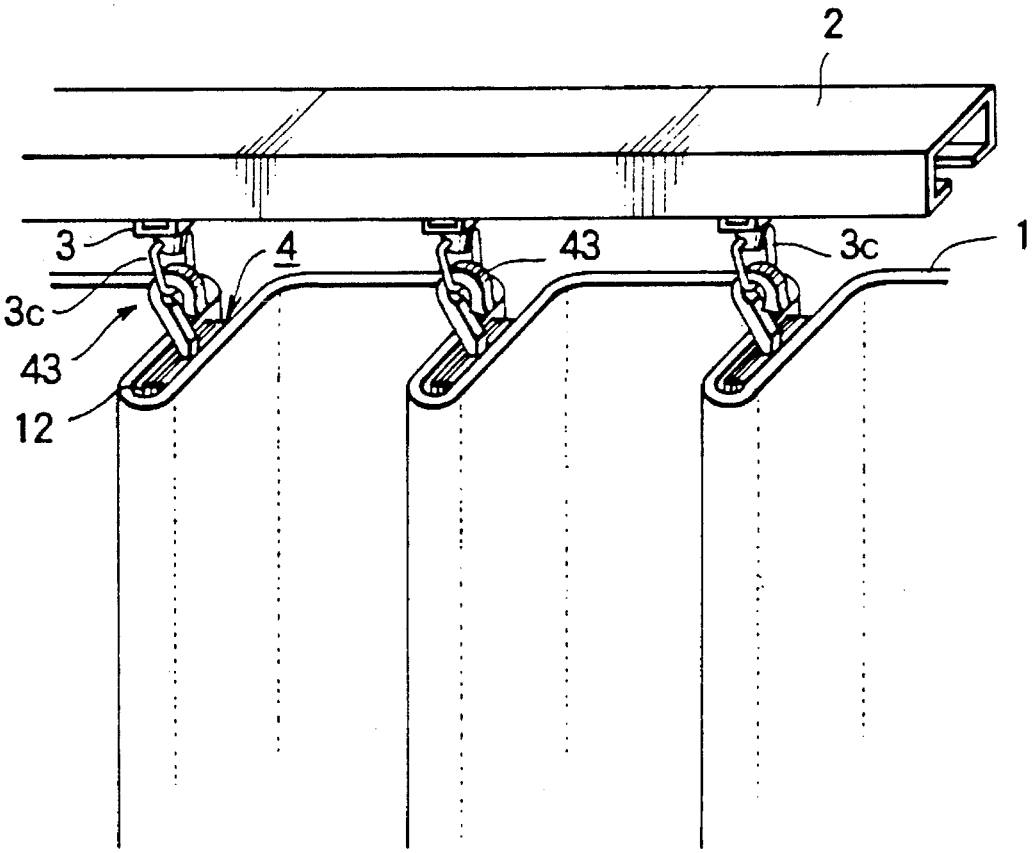
FIG. 9 is a fragmentary perspective view showing the manner in which the curtain with gatherings formed by using the connector is suspended.
Figure 10:
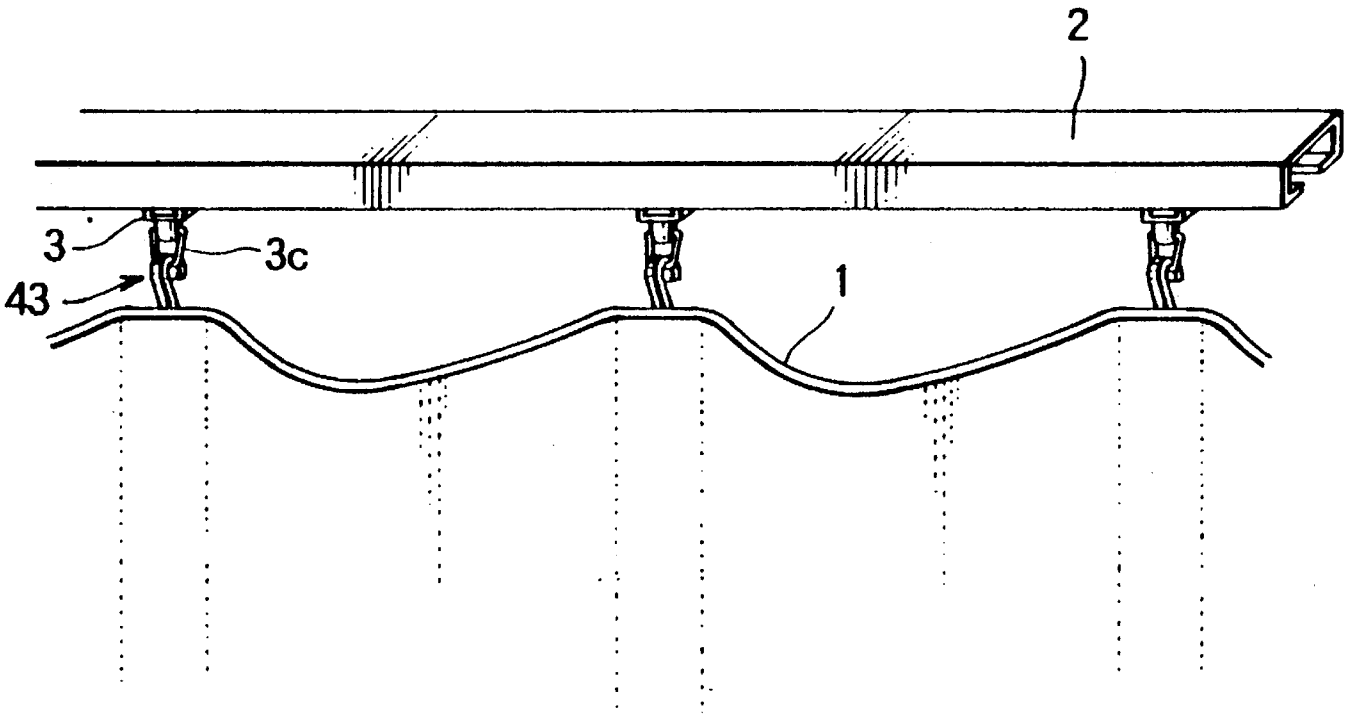
FIG. 10 is a fragmentary perspective view showing the manner in which the unpleated curtain is suspended when the gatherings come off.
Figure 11:
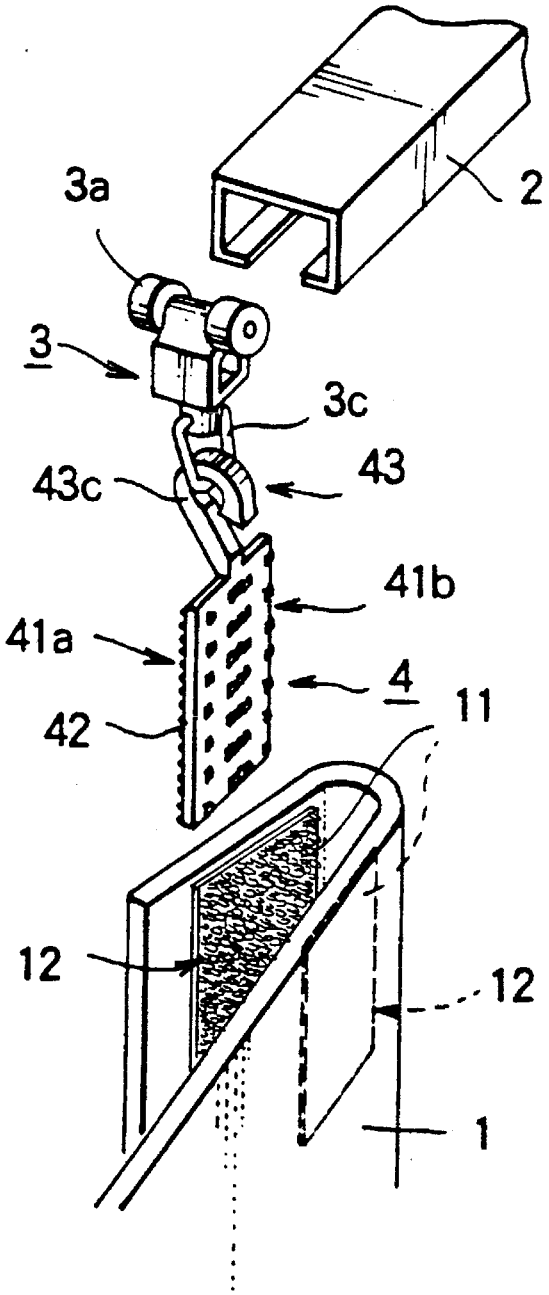
FIG. 11 is a fragmentary, exploded perspective view showing the manner in which and end of the curtain is suspended using the connector.

FIGS. 9 through 11 show examples of different uses of the connector 4 of this invention. FIG. 9 shows the curtain having gatherings; FIG. 10 shows the curtain without gatherings; and FIG. 11 shows the connector 4 used at the end of the curtain 1.

When pleating the curtain 1, the fastener member 42 of the connector 4 is inserted between a pair of female surface fasteners 12 that is attached to and along the upper edge of the curtain 1, as shown in FIG. 9, then the pair of female surface fasteners 12 is pressed on both sides of the inserted fastener member 42, thus attaching each of the female surface fasteners 12 to the respective engaging face 41*a*, 41*b*. Thus, the connector 4 of this invention eliminates the need of laborous previous gathering process of the curtain 1, and instead, uniformly distributed gatherings are formed on the curtain 1 when the curtain 1 is attached to the railing.

Since the curtain attachment connector 4 of this invention has different engaging strength on each side of the fastener member 42, as mentioned above, if the gatherings are formed on the curtain, with the first engaging face 41*a* of each connector 4 being attached to the curtain 1 in such a way as to face in a common direction, when the curtain 1 is pulled forcibly from the second engaging face 41*b* side that has weaker engaging strength, facing in the opposite direction, each connector 4 rotates horizontally to cause the second engaging face 41*b* to be detached, one by one, from the female surface fasteners 12 of the curtain 1 so that the curtain 1 loses gatherings, as shown in FIG. 10.

When a pair of female surface fasteners 12 is attached to a transverse end corner of the curtain 1 as shown in FIG. 11, the connector 4 of this invention can be affixed to the upper corner of the curtain 1 with the end of the curtain folded horizontally, thereby hiding the connector 4 by the upper end of the curtain 1, and at the same time flares appear at the bottom end of the curtain, eliminating the risk of showing a gap at the transverse end of the curtain 1.

With difference in the engaging strengths of the first and second engaging faces 41*a*, 41*b*, which is a characteristic feature of this invention, the curtain attachment connector 4 has the following additional advantages. Because of the different engaging strength on either side of the connector 4, a temporary downward impact at the time of opening and closing of the curtain 1 can be buffered, as the weaker engaging strength of the second engaging face 41*b* lets go the adherence first at the engaging face 41*b*, keeping the first engaging face 41*a* to the curtain 1 intact. It also protect the synthetic resin attachment 43 of the connector 4 from the shock, thus eliminating deformation or damage to the connector 4 and frequent replacement of the connector 4.

The connector 4 described in U.S. Pat. No. 5,012,552 and of U.S. Pat. No. 5,109,912, as explained above, uses regular surface fasteners made of fabric material as the engaging faces on both sides, thereby causing no specific problem in manufacturing, for instance, hooks are formed because they are formed under the conventional method.

When the hooks 40*a*, 40*b* of the first and second engaging faces 41*a*, 41*b* are molded integrally with the fastener member 42 to produce a surface fastener, as shown in FIG. 1 by extrusion or injection molding to improve productivity, however, in the extrusion molding with the rotating drum as mentioned above, since the numbers of hooks of either sides of the fastener member 42 are different from each other, levels of resistance on each side to the pulling force to pull hooks 40 off together with the fastener member 42 from the surface of the drum along rotation of the drum are different. Therefore, the hooks 40*b* of the second engaging face 41*b* come off first, followed by the hooks 40*a* of the first engaging face 41*a* so that the smooth taking-up of the molded product and reliable molding are realized.

When the fastener member 42 with different density of hooks on each side is molded by injection molding, as the mold of the injection molding machine is opened to take out the product, the side toward the first engaging face 41*a* invariably stays on the metal molding, because the area contacting the mold varies between the first and second engaging faces 41*a*, 41*b* of the connector 4 of this invention.

Therefore, an ejector pin is required only for the metal mold on the side of the first engaging face 41*a*, thus avoiding complex structure of the molding machine, keeping the production cost at a reasonable level as well.

As is clear from the foregoing description, the curtain attachment connector 4 of this invention has numerous hooks 40 on both sides of the plate-like fastener member 42 to form the first and second engaging faces 41*a*, 41*b*. Therefore, the fastener member 42 of the curtain attachment connector 4 is placed between a pair of female surface fasteners 12 attached at desired intervals along the upper edge of the curtain 1. Then the engaging faces 41*a*, 41*b* and the corresponding female surface fasteners 12 engage as being to create gatherings on the curtain 1 with ease.

Since the connector 4 of this invention has the first and second engaging faces 41*a*, 41*b* on both sides of the fastener member 42, a pair of female surface fasteners 12 engage with the first and second engaging faces 41*a*, 41*b*, thus increasing the engaging strength per curtain attachment connector 4 and eliminating the need to add the connectors 4 to hold heavy-weight draperies.

By using the connector 4 of this invention on the upper transverse end of the curtain 1, strong adherence is obtained even at the ends of the curtain 1 to which larger pull load at the time of opening and closing the curtain 1 is exerted, due to the firm adherence between the first and second engaging faces 41*a*, 41*b* on both sides of the fastener member 42 and a pair of female surface fasteners 12 attached to the curtain 1. This also prevents curtain ends from coming off the connector 4 and at the same time minimizes gaps at the end of the curtain 1, because of the flares created at the bottom of the curtain 1.

Because the engaging strength of the second engaging face 41*b* on one side of the fastener member 42 is weaker than that of the first engaging face 41*a* on the other side of the fastener member 42 in the connector 4 of this invention, the second engaging face 41*b* easily comes off the female surface fastener 12 attached to the curtain 1. When the curtain 1 is pulled transversely to tear the female surface fastener 12 on the curtain 1 off the engaging faces of the connector 4, the female surface fastener 12 comes off the second engaging face 41*b* that has weaker adherence. As a result, the curtain 1 loses its gatherings. Conversely, when the gatherings should be formed on the curtain 1, the curtain 1 can have gatherings by opening the curtain 1, as folding the upper end of the curtain 1 at a soft spot between a pair of female surface fasteners 12, then facing the second engaging face 41*b* the female surface fastener 12 for automatic engagement.

By previously setting the direction of the engaging face with better engaging strength and of the engaging face with less engaging strength of the connector 4, the connectors 4 are distributed at equal intervals along the entire transverse length of the curtain 1, when the female surface fasteners 12 on the curtain 1 are torn off the engaging face with weaker engaging strength, thus enabling the connectors 4 to suspend the curtain 1 with uniform strength across the transverse upper edge. The curtain attachment connectors 4 are uniformly distributed for better appearance as well.

The curtain attachment connector 4 of this invention also ensures to buffer the downward, temporary impact at the time of opening and closing of the curtain 1, because the second engaging face 41*b* that has weaker engaging strength first comes off, but still keeping the adherence of the stronger first engaging face 41*a*. This also protects the synthetic resin attachment 43 of the connector 4 from the shock, thus minimizing deformation and damage to the connector 4 and the frequent need to replace the device.

By setting the density of hooks 40*a*, 40*b* on the first engaging face 41*a* and the second engaging face 41*b* at different levels, the engaging strength of the second engaging face 41*b* is reduced as mentioned above. In addition, in the process of manufacturing the curtain attachment connector 4 by integral molding, and particularly by injection molding, hooks 40*b* on the side of the second engaging face 41*b* come off the metal mold easily, leaving the molded product inside the metal mold on the side of the first engaging face 41*a*. Therefore, ejector pins are required only on the side of the first engaging face 41*a* of the metal mold, thus minimizing influence on price of injection molding machine and keeping production cost at a reasonable level.

What is claimed is:

1. A curtain attachment connector movable along a guide member, being disposed between said guide member and a curtain having a number of male or female engaging faces at predetermined intervals on and along the upper edge, and having engaging faces which engage with said engaging faces of said curtain, said curtain attachment connector comprising a plate-like fastener member having said engaging faces, and an attachment extending from one end of said fastener member and adapted to be mounted to said guide member, wherein said engaging faces of said fastener member including first and second engaging faces composed of a multiplicity of hooks rising from front and back sides of said fastener member, and wherein said first and second engaging faces having different engaging strengths from each other.

2. A curtain attachment connector according to claim 1, wherein said fastener member and said attachment are molded integrally.

3. A curtain attachment connector according to claim 2, wherein said attachment has a hook-shape.

4. A curtain attachment connector according to claim 2, wherein said attachment has a neck protruding from one end of said surface fastener, and a flange formed on at least a free end of said neck.

5. A curtain attachment connector according to claim 1, wherein said attachment has a hook-shaped member attached to said surface fastener so as to rotate freely about a vertical axis of said attachment.

6. A curtain attachment connector according to claim 1, wherein said hooks of said first and second engaging faces are integrally molded on the respective front and back sides of said fastener member.

7. A curtain attachment connector according to claim 1, wherein said fastener member has first and second substrate sheets in the form of woven or knitted fabrics, said hooks of said first and second engaging faces being formed by cutting a part of each of loops of monofilament woven or knitted with said first and second substrate sheets, the respective back sides of said first and second substrate sheets being adhered onto said front and back sides of said fastener member.

8. A curtain attachment connector according to claim 1, wherein said fastener member is composed of first and second substrate sheets on which said hooks of said first and second engaging faces are respectively molded, said first and second substrate sheets being adhered onto each other's back side.

9. A curtain attachment connector according to claim 1, wherein saint first and second engaging faces are different in hook density from each other.

10. A curtain attachment connector according to claim 1, wherein said hooks of said first and second engaging faces are made of materials different in rigidity from each other.

11. A curtain attachment connector according to claim 1, wherein each of said hooks of one of said first and second engaging faces has a curving portion shorter than that of each of said hooks of the other engaging face.

* * * * *